United States Patent [19]

Schneider

[11] Patent Number: 5,050,266

[45] Date of Patent: Sep. 24, 1991

[54] VACUUM CLEANER ADAPTER FOR MICRO TOOLS

[76] Inventor: Norman J. Schneider, 1120 S. King St., Honolulu, Hi. 96814

[21] Appl. No.: 439,918

[22] Filed: Nov. 21, 1989

[51] Int. Cl.[5] ..... A47L 9/02

[52] U.S. Cl. ..... 15/421; 15/415.1; 15/330; 15/375; 15/376; 7/285

[58] Field of Search ..... 15/400, 421, 376, 415.1, 15/330, 405, 375; 285/7; 251/285, 286

[56] References Cited

U.S. PATENT DOCUMENTS

| | | | |
|---|---|---|---|
| 1,801,717 | 4/1931 | Brooks | 251/286 |
| 3,230,569 | 1/1966 | Nielsen | 15/421 |
| 3,332,101 | 7/1967 | Leinfelt | 15/421 |
| 3,986,737 | 10/1976 | Krusche | 285/7 |
| 4,114,230 | 9/1978 | MacFarland | 15/415.1 |
| 4,387,880 | 6/1983 | Saarisalo et al. | 251/286 |
| 4,405,158 | 9/1983 | Huberman | 15/415.1 |
| 4,476,607 | 10/1984 | Ross | 15/393 |
| 4,479,281 | 10/1984 | Mikutowski | 15/303 |
| 4,506,406 | 3/1985 | LaMonte | 15/398 |
| 4,642,097 | 2/1987 | Siposs | 15/421 |
| 4,686,737 | 8/1987 | Fortune | 15/415.1 |
| 4,688,295 | 8/1987 | Starnes | 15/395 |
| 4,694,529 | 9/1987 | Choiniere | 15/395 |

FOREIGN PATENT DOCUMENTS

| | | | |
|---|---|---|---|
| 592530 | 2/1960 | Canada | 15/421 |
| 2719155 | 11/1978 | Fed. Rep. of Germany | 15/415.1 |

*Primary Examiner*—Philip R. Coe
*Assistant Examiner*—Patrick Brinson
*Attorney, Agent, or Firm*—Sughrue, Mion, Zinn Macpeak & Seas

[57] ABSTRACT

A vacuum cleaner adaptor for micro tools consisting of an adaptor body of tubular form having a large diameter section for fitting to a conventional vacuum cleaner vacuum intake port or positive air pressure discharge port, an integral conical transition section and a small diameter section for fitting to a small diameter hose or tube or to the micro tool per se. In one form, longitudinal slots of arcuate configuration are formed within the conical transition section of the adaptor body at circumferentially spaced positions and are selectively closed off by a rotatable conical form shield having similar sized longitudinal slots therein. Radially projecting members on the shield and adaptor body limit rotation of the shield relative to the body between a full slot open position and a slot partially open position by circumferentially offsetting the slots of the adaptor body and shield. In a further embodiment, oblique holes are formed within the adaptor body large diameter section, oblique to the longitudinal axis of the tubular body. A sector shaped solid shield is rotatably mounted on the body for closing off given oblique holes to reduce air flow through the oblique holes as desired while ensuring sufficient air flow for preventing overheating of the vacuum cleaner motor of air cooled or air passed type.

10 Claims, 2 Drawing Sheets

VACUUM CLEANER ADAPTER FOR MICRO TOOLS

FIELD OF THE INVENTION

This invention relates to a coupling tube adapter for connecting small diameter positive air pressure or vacuum operated tools to the suction inlet or air discharge port or tube of a vacuum cleaner for access to tight spaces such as cleaning typewriters and the like, and more particularly, to such coupling tube adapter which insures sufficient air flow to the vacuum cleaner to prevent overheating of the vacuum cleaner motor.

BACKGROUND OF THE INVENTION

Conventional vacuum cleaners employ air cooled or air pass through motors for preventing overheating of the vacuum cleaner motor during operation. For operation of small diameter vacuum pressure or positive air pressure driven tools for access to tight spaces, a connection tube assembly or adapter includes a large diameter tube section for attachment to the suction or positive air pressure sides of the vacuum cleaner and a much smaller diameter tube sized to the tool and coupled directly thereto or via a similar sized hose.

Domestic vacuum cleaners sold in the marketplace come in different forms, namely upright, canister, combination canister with upright features of a revolving brush, stick types, hand vacs, shop vacs and battery operated miniature vacs.

Vacuum cleaners, with the exception of the battery operated miniature vacs, use conventional size attachments to either the vacuum side of the (air intake) vacuum cleaner or the positive air pressure discharge side. Generally speaking, the opening or orifice of the hose section coupled to the vacuum intake or air discharge side of the vacuum cleaner has a 1¼ inch inside diameter. Such hose section diameter may vary slightly. The corresponding attachment to these hoses are normally of conventional size and type, for good reason. Air flow is very important. The inside diameter of the attachments permit enough air flow through the attachments to keep the vacuum motor from overheating during operation since most domestic vacuum cleaners use air cooled (or air pass through) motors. Additionally, because the size of the debris being picked up by the vacuum hose can vary to a large degree, a sufficiently large orifice is required to prevent clogging of the attachments. This relatively large size is also needed to deliver enough suction at the point where the attachment picks dust or debris.

Due to the shear size or bulkiness of the attachments, it is impossible for conventional domestic or commercial vacuum cleaners to clean small confined areas such as typewriter keys and the many parts involved in computers and the like.

Miniature (tiny) battery operated vacuum cleaners are currently being sold in the marketplace which have hoses whose diameters are significantly smaller and which claim capability of cleaning such confined areas. However, because of their very size, their usefulness in terms of air flow is significantly limited. Further, because as battery life decreases, so does the air flow, they are normally incapable of providing adequate air flow for an extended period of time. Attempts have been made to meet the need by utilizing tubular attachments having a large diameter section coupled directly to the vacuum cleaner, and a smaller diameter section integral therewith for attachment to the smaller diameter too. Such adapters or coupling attachments are the subject of the following U.S. patents:

| U.S. Pat. No. | Issue Date | Inventor | Title |
|---|---|---|---|
| 3,230,269 | 1/25/66 | Nielsen | Vacuum Cleaner for Automobiles |
| 4,405,158 | 9/20/83 | Huberman | Air Filler Adapter |
| 4,053,962 | 10/18/77 | McDowell | Suction-Cleaning Dust Retriever |
| 4,114,230 | 9/19/78 | MacFarland | Deflator-Inflator Attachment |
| 4,476,607 | 10/16/84 | Ross | Portable Vacuum Cleaning Device |
| 4,479,281 | 10/30/84 | Mikutowski | Method and Apparatus for Cleaning Phonograph Records |
| 4,506,406 | 3/26/85 | LaMonte | Attachment Tool for a Vacuum Cleaner Hose |
| 4,688,295 | 8/25/87 | Starnes | Vacuum Cleaner Attachment |
| 4,694,529 | 8/22/87 | Choiniere | Suction Device |

The patents above evidence adapters or extension devices for vacuum cleaners in which the tool bore diameter is considerably less than that of the tube connection to the vacuum cleaner tubular air inlet on the suction side or the positive air pressure discharge on the outlet side of the vacuum cleaner.

Huberman and McDowell lack the provision for air flow other than that through the small diameter axial port on the small tube side of the adapter.

Choiniere employs a large oval opening within the bottom wall of the adapter. Further there is an elongated slot within the adapter tip adjacent to a hole therein. However, the purpose is not to increase the air flow to protect a vac motor but to provide two suction areas within the end and bottom of the blade.

In Nielsen, an elongated slot within the end of a flat flared nozzle provides the primary suction opening for a mini sized vacuum cleaner, in this case attachable to the intake manifold of an automobile engine. The existence of perforations within upper and lower walls permit additional air flow through the adapter but in Nielsen, there is no vacuum cleaner or vacuum cleaner motor needing protection.

Starnes is representative of a tool having a tube diameter corresponding to the hose size of the conventional vacuum cleaner and coupled to the intake. The attachment facilitates cleaning of narrow spaces between furniture pieces and employs narrow elongated brush elements on the end of the tube or alternatively, a further annular cleaning brush with a hollow end bearing the brush bristles and presumably an axial bore.

The prior art known to the applicant teaches adapters for supporting small diameter tools, with the adapters including a larger diameter tubular portion for coupling to a conventional vacuum cleaner hose or directly to the vacuum or positive air pressure ports of a conventional vacuum cleaner.

It is therefore a primary object of the present invention to provide an improved miniature vacuum tool adapter or attachment converter providing dramatic increase in air flow by attachment to a large size domestic or commercial vacuum cleaner which insures prolonged air flow which reduces the possibility of clogging, which insures air flow adequate to prevent overheating of the vacuum cleaner motor and in which the total air flow through the vacuum cleaner may be readily adjusted by varying the size of supplemental openings within the adapter itself.

SUMMARY OF THE INVENTION

The invention is directed to a vacuum cleaner adaptor for a micro tool for a vacuum cleaner employing an air cooled or air pass through motor for the prevention of overheating of the vacuum motor during operation. The adaptor comprises a tubular assembly adaptor or body consisting of a large diameter tube section for attachment to the suction or positive air pressure side of the vacuum cleaner, a small diameter tube section sized to the micro tool and an integral transition section connecting the large diameter section to the small diameter section. One of the adaptor body sections comprises a plurality of air flow ports opening to the interior of the adaptor and a shield movably mounted on the section carrying the plurality of ports for movement between a first position in which the ports are fully open to air flow between the interior and the exterior of the adaptor body section and a second position in which the ports are partially closed off to the air flow thereby ensuring prolonged air flow adequate to prevent overheating of the vacuum cleaner motor. The transition section between the adaptor body large diameter and small diameter sections is preferably of conical form with the air ports comprising circumferentially spaced slots Within the conical form section. The movable shield may constitute a conical member concentrically mounted on the adaptor body in flush contact with the conical section of the body and having circumferentially spaced slots in general longitudinal alignment with the slots within the adaptor body conical section. Means are provided for mounting the conical shield for limited rotation relative to the adaptor body to shift the shield from a position where the slots are in axial alignment to one where the slots are offset to reduce the air flow therethrough. A stop ring may be concentrically mounted about the small diameter section of the adaptor body with one end face in radial abutment with the conical shield to maintain the conical shield surface in contact with the exterior of the conical section of the adaptor body. The adaptor body small diameter section may include a plurality of radially projecting abutments projecting outwardly from the outer surface thereof towards the radially inner surface of the shield a small diameter portion. The shield small diameter portion may include a like number of radially inwardly directed projections on the inner diameter thereof facing the outer periphery of the adaptor body small diameter section and being spaced radially therefrom to form arcuate gaps between the abutments, the width of which gaps permit rotation of the shield member over an angular extent between a first position where the slots of the shield and the adaptor body are in full alignment for maximum air flow and a second position where the slots are circumferentially offset for reduced air flow therethrough.

In another embodiment, the large diameter section of the adaptor body may include a radially projecting rib intermediate of the ends thereof and a radially projecting end wall proximate to the transition section, axially spaced from said rib and defining a circumferential recess between the rib and the radially projecting end wall. The shield may consist of a semicircular cylindrical section of solid sector shape having an inner diameter slightly in excess of the outer diameter of the adaptor body recess and being concentrically mounted thereto with opposite ends in abutment with the radial rib and radially enlarged end wall, respectively. The multiple air flow ports may comprise a plurality of holes within the adaptor body large diameter section at the recess. oblique to the axis of the adaptor body and in a circumferential arrays whereby rotation of the sector shape shield selectively closes off the oblique holes to vary the rate of air flow through the adaptor.

DESCRIPTION OF THE PREFERRED EMBODIMENTS

Figure 1:
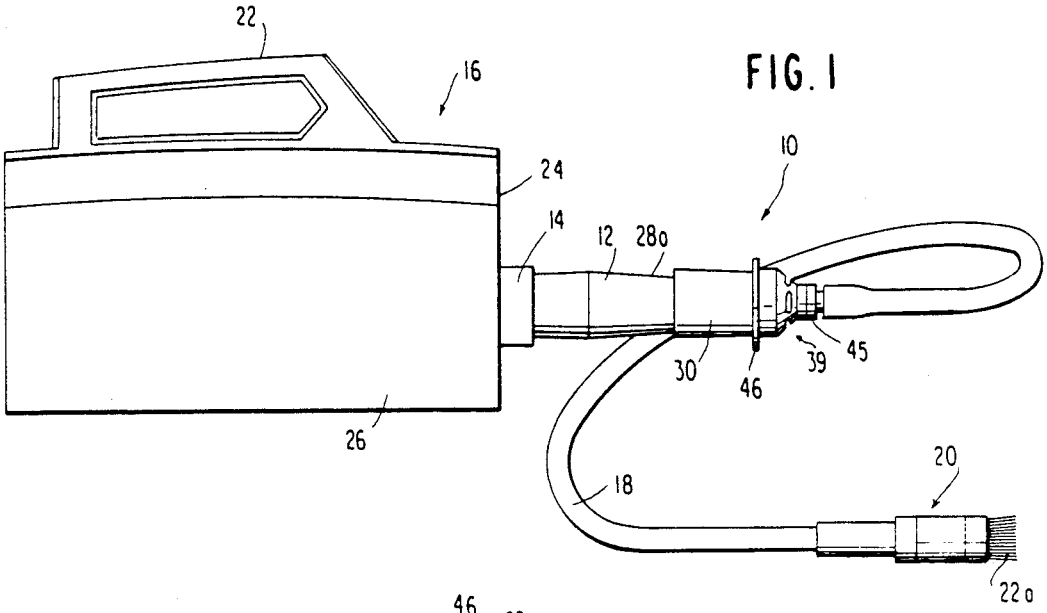
FIG. 1 is a perspective view of the vacuum cleaner adapter for a micro tool forming a preferred embodiment of the invention coupled to the suction port of a domestic vacuum cleaner at one end at the other end by a small diameter tube to such micro tool.

Referring to FIGS. 1-4 inclusive, a vacuum cleaner micro tool adapter forming a preferred embodiment of the invention is indicated generally at 10, and is shown as being coupled at one end by a tubular coupling 12 to a suction port 14 of a domestic vacuum cleaner indicated generally at 16. The other end of the adapter 10 is coupled via a small diameter flexible hose or tube 18 to a micro tool indicated generally at 20.

The opposite end of the vacuum cleaner 10 to the rear of handle 22 on housing 26 is provided with a positive air discharge port (not shown) of a diameter equal to that of the suction port 14. The suction port 14 is formed by an axially projecting short length cylinder projecting outwardly of front wall 24 of vacuum cleaner housing 26. The suction part 14 orifice is of standard $1\frac{1}{4}$ inch diameter. The tubular, male coupling 12 takes the form of a short length (several inches) plastic tube having an outer surface which is beveled inwardly from its axial center in opposite directions, i.e., tapered towards its opposite ends so as to permit one end to be frictionally inserted into the orifice of the large diameter cylindrical coupling section 30 of adapter 10 and the other within the suction port 14 orifice.

Figure 4:
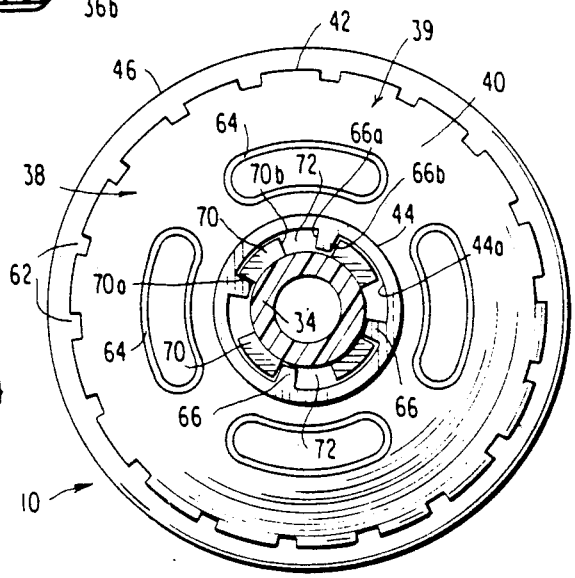
FIG. 4 is an end view of the adapter of FIGS. 1-3 inclusive.
Figure 3:
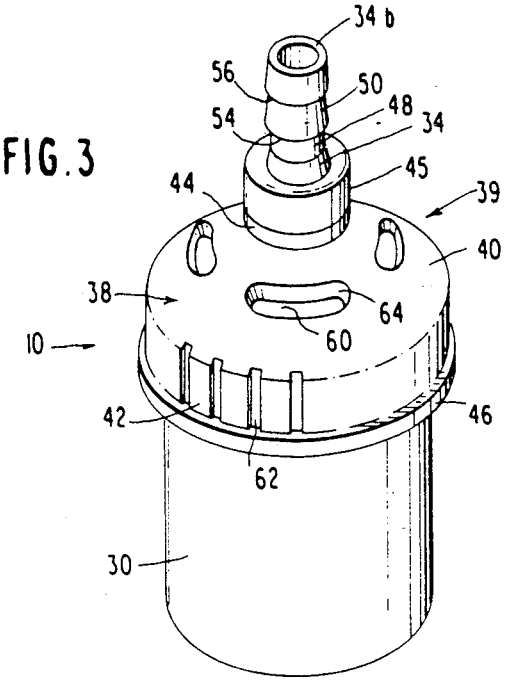
FIG. 3 is an enlarged, perspective view of the adapter of FIG. 2.
Figure 5:
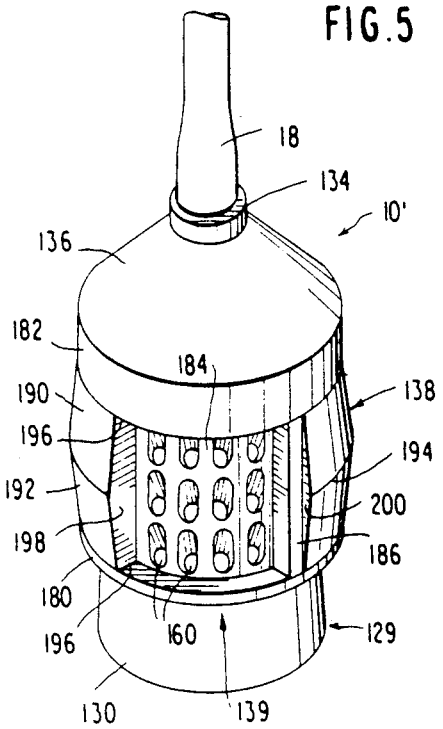
FIG. 5 is a perspective view of an adapter forming a second embodiment of present invention under full power conditions.
Figure 6:
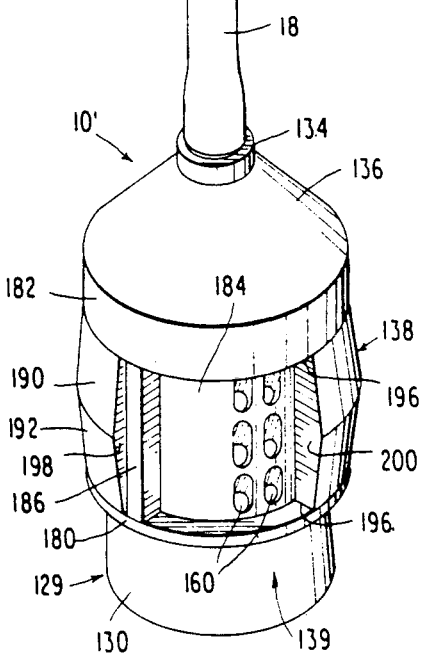
FIG. 6 is a perspective view similar to that of FIG. 5, with the adapter at half power.

The adapter 10 of FIGS. 1-4 inclusive and adapter 10' of FIGS. 5 and 6 form two separate embodiments of the invention and each adapter takes the form of an adapter body and includes three major sections; a large diameter cylindrical coupling section, a conical transition section, and a small diameter cylindrical coupling section.

Figure 2:
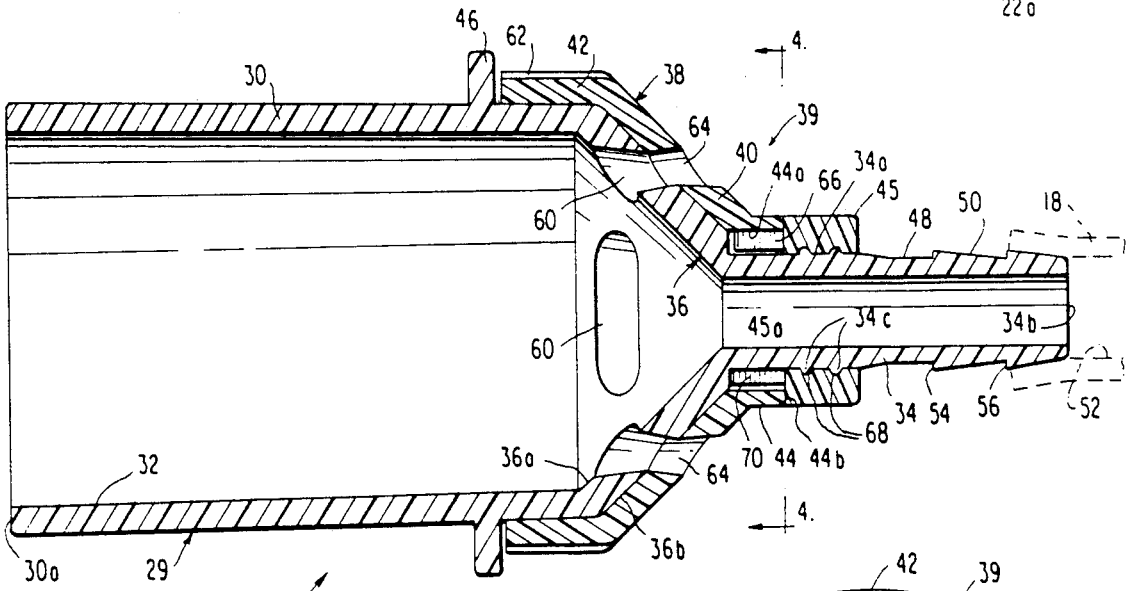
FIG. 2 is an axial, sectional view of the adapter of FIG. 1.

For the first embodiment 10, adapter body 29 includes a large diameter cylindrical coupling section 30 having a bore 32 which is preferably $1\frac{1}{4}$ inch in diameter for standard connection to a domestic or commercial vacuum cleaner hose or suction port (such as port 14 of the vacuum cleaner 16, FIG. 1). The open end 30*a* of the large diameter cylindrical section 30 receives the tapered external surface 28*a* of the male coupling 12, FIG. 1. The large diameter cylindrical section 30 connects integrally to a small diameter cylindrical coupling section 34 via a unitary conical transition section 36. All of the components of adapter 10 may be formed of molded plastic such as Polyvinyl Chloride (PVC). In that respect, the conical transition section 36 of body 29 functions as one element of a valve section indicated generally at 39, the other element of which is a rotatable shield indicated generally at 38. FIG. 2. The rotatable shield 38 is a frustro-conical molded plastic member having a conical portion 40 integrally molded to a large diameter cylindrical portion 42 at one end, and a short length, small diameter cylindrical portion 44 at the other end. The inner diameter of the large diameter cylindrical portion 42 is slightly larger than the outer diameter of cylindrical section 30 of the adapter body 29 supporting the shield 38. In turn, the inner diameter of cylindrical portion 44 of the rotatable shield 38 is slightly larger than the outer diameter of the cylindrical section 34 of the adapter body 29. The angulation of the conical section 36 of body 29 matches the angulation of the conical portion 40 of the rotatable shield 38. The adapter body 29 and the rotatable shield 38 are essentially in surface contact.

The large diameter cylindrical section 30 of the adapter body 29 is provided with an integral, radially projecting rib 46 adjacent to end 42*a* of the large diameter cylindrical portion 42 of the rotatable sheet 38. The small diameter section 34 of the adapter body 29 is provided on its outer surface 34*a*, with a number of annular grooves 48, 50 which are longitudinally oblique, of increasing depth from left to right and towards the open end 34*b* of the small diameter adapter body section 34. An elastic plastic tube or hose 18 is sized such that its inner diameter or bore 52 is slightly smaller than the outside diameter of section 34 of the adapter body and the flexible plastic tube 18 is force-fitted onto the outer peripheral surface 34*a* of the small diameter section 34. Edges 54, 56 formed by the oblique grooves 48. 50 function as barbs for permitting the tube 18 to be force-fitted onto the end of the small diameter section 34 of the body but resisting removal of tube 18. Means are provided for maintaining the axial position of the rotatable shield 38, while permitting limited rotation of the shield concentrically about the adapter body 29.

The conical transition section 36 of the adapter body 29 is provided with a plurality (four) of elongated arcuate slots 60 at circumferentially spaced positions, which slots 60 taper inwardly from the inner wall 36*a* of the transition section to its outer wall 36*b*. The outer periphery of the large diameter cylindrical portion 42 of the rotatable shield 38 forming with adapter body 29, air release valve 39, is knurled at 62 to facilitate hand rotation of the movable shield 38 relative to the adapter body 29. Similar sized and numbered arcuate slots 64 are formed within the rotatable shield 38 conical portion 40, at common radial positions with body 29 corresponding to slots 60. The slots 60. 64 of respective members are such as to be perfectly aligned in full open position of the air release valve 39.

Rotation of the air release valve 39 over a limited arcuate path results in misalignment of slots 60. 64 and partial closure of slots 60 to reduce the air flow passing through slots 60 64. Stops are provided at the small diameter portion sections 34 of the body 29 and small diameter portion 44 of the rotatable shield 38. As may be seen by reference to FIGS. 2 and 4, which is a sectional view of FIG. 2 taken about line 4—4, the small diameter portion 44 of the rotatable shield 38 is provided with radially inwardly directed projections or tabs 66 from the radially inner wall 44*a* of the small diameter portion 44 of the rotatable shield 38.

The small diameter cylindrical portion 44 of the rotatable shield is of a short axial length and terminates in a radial end wall 44*b*. Fixedly mounted to the exterior of the small diameter cylindrical section 34 of the adapter body 29 is an annular stop ring 45 having an inner diameter on the order of the outer diameter of the cylindrical section 34 of body 29. Further, the small diameter section 34 of body 29 is provided with a pair of longitudinally spaced circumferential ribs 34*c* of semicircular cross section which project radially outwardly of the small diameter section 34. The stop ring 45, which may be formed of a resilient plastic, rubber or the like, is provided with matching semi-circular cross sectional grooves 68 which receive the radially projecting ribs 34*c* to axially lock the stop ring in a position where radial end face 45*a* of the stop ring abuts radial end face 44*b* of the rotatable shield 38. This maintains the surface contact between the conical portion 40 of the rotatable shield and the conical section 36 of the adapter body 29.

In addition to ribs 34*c*, the adapter body 29, at the juncture between the conical section 36 and the small diameter section 34 of that member, is provided with radially outwardly projecting arcuate abutments 70 which are of a radial height so as to terminate just short of contact with the inner wall or bore 44*a* of the small diameter cylindrical portion 44 of the rotatable shield 38. There are four abutments 70 corresponding to the four radial projections 66 of the rotatable shield 38 and the abutments 70 are angularly oriented so as to occupy a position between adjacent projections 66, see FIG. 4. Additionally, the abutments 70 extend circumferentially approximately 50° leaving a radial gap 72 between the end face of one abutment and the end face of the projection to the opposite side of the gap 72, while the opposite radial end face of the abutment 70 is in contact with a radial end face of the other radial projection 66, between which a given abutment 70 is located.

As shown in FIG. 4, by rotation of the rotatable shield 38 from the position shown in FIG. 4 which is the closed position for the air release valve 39 with maximum circumferential misalignment between slots 60 and 64, the radial projections 66 rotate counterclockwise with radial face 66*b* of projections 66 moving away from radial end face 70*a* of each abutment 70, while each outer projection 66 has its radial and face 66*a* moving into contact with radial end face 70*b* of a corresponding abutment 70. The extent of rotation is therefore about 25° from full open position of the air valve to partial open position. The angular misalignment between ports 64 of the air valve movable shield 38 and ports 60 of adapter body 29 may be seen by the dotted line position of port 64 of the movable shield 38. FIG. 4.

The air release valve 39 formed by components 38, 29 is in at least partially open position at all times to prevent overheating of the domestic or commercial vacuum cleaner motor. Further, the air release valve 39 can be regulated by providing more openings, if desired, when larger motors are used as the power source for the domestic or commercial vacuum cleaner. The stoppers or abutments 70 limit rotation of the rotatable (movable) shield 38 between the max open and near one half closed positions. The openings in the adaptor body are designed to accommodate vacuum cleaners that have suction power measured in inches of waterlift from twenty (20) inches to one hundred two (102) inches. With the slots of the adaptor body fully open enough passage of air is ensured through the vacuum cleaner motor measuring the 102 inches of waterlift to prevent overheating of the motor. Preferably, the tube 18 is a 5/16 inch hose section and is attached at its opposite end to an appropriate vacuum (or positive air pressure) operated tool such as tool 20. Tool 20 is depicted as having a brush formed by a bristle section 22*a* of annular form permitting vacuum pulling of particles dislodged under brush operation through the core of the annular brush 22*a* and through the bore of the small diameter plastic tube 18. Alternatively, if the hose section 18 is connected to the positive air pressure or blower side of the domestic or commercial vacuum cleaner 26 (not shown). the hose section can be directed to confided areas to blow out dust or debris with or without the tool 20 (brush) attached to the free end of the small diameter tube 18 remote from its connection to adapter 10.

Since the adapter 10 can be attached to virtually any vacuum cleaner which uses attachments, it provides an opportunity for use of both domestic and commercial vacuum cleaners with attachments to safely convert their vacuum, for use with a miniature vacuum attachment set. Work may be accomplished in confined areas such as photo equipment, computers, arts and crafts, office machines, stereo equipment, household use, tape decks, machining, hobbies, jewelry, keyboards, lenses, electronic turntables and the like. The adapter or miniature vacuum attachment converter 10 safely converts any domestic or commercial vacuum cleaner that uses attachments for use with miniature attachments such as the tool 20 illustrated in FIG. 1. The air flow (CFM) is dramatically increased through the miniature attachment because of the nature of the power source, the receptacle for retaining the collected dust is dramatically increased over a standard miniature vacuum cleaner. The size of the dust receptacle also prolongs the air flow since miniature battery operated vacuum cleaners have a minuscule dust receptacle that can clog easily and can reduce air flow to almost zero in a short period of time. By using the adapter 10 of this invention with a full size vacuum cleaner, the power source if uniform over prolonged use of the adapter and its tool.

FIGS. 5 and 6 illustrate a second embodiment of the invention. In this embodiment, adapter 10' takes the form of an elongated molded plastic tubular body indicated generally at 129 and includes, integrally, a large diameter cylindrical coupling section 130 from which projects radially outwardly, an annular rib 180 intermediate of its ends. A radially enlarged end at 182 forms with rib 180, an annular peripheral recess 184 therebetween. The adapter body 129, similar to the first embodiment, includes integrally a conical transition section 136 with the large diameter cylindrical coupling section 130. Section 136 terminates at the side opposite section 130 in a reduced diameter cylindrical coupling section 134. Tube 18 attaches to the small diameter cylindrical coupling section 134 in the same manner as the first embodiment, and the balance of the assembly shown in FIG. 1 with adapter 10' is employed in use as depicted in FIG. 1.

A rotatable shield indicated generally at 138 is provided, of cylindrical form. Shield 138 is sector shaped, that is, it is not a complete cylinder having longitudinal end faces 198 and 200 circumferentially spaced approximately 90°. The balance of the rotatable shield 138 is of a solid cylindrical form defined by opposite axial end faces 196 and oppositely tapered or oblique outer side wall sections 190, 192 from an axial center line 194 extending circumferentially about the shield 138. The rotatable shield 138 forms, in conjunction with the large diameter cylindrical coupling section 130 of body 129, an air release valve 139.

In that respect, circumferentially spaced and longitudinally spaced holes 160 pass through the wall of section 130. The holes 160 are in longitudinal rows, side by side with the holes being drilled or otherwise formed oblique to the axis of body sections 130 rather than radial. Holes 160 are directed obliquely towards the small diameter cylindrical coupling section 134, from the inside surface of tubular adapter body section 130 towards the outside surface of recess 184 of the body section 130. If the holes 160 were radial, the holes tend to create an extremely undesirable noise when air is being passed through a confined area. By oblique angling the air holes or openings 160 to the axis of the body section 130, a number of degrees from radial, the noise reduces dramatically when the tool employed with the adaptor 10' is in operation with the cylindrical coupling section 130 coupled to a hose section of the vacuum cleaner 16, FIG. 1, or directly to a port such as suction port 14 (or the positive air pressure blower port thereof (not shown)).

In FIG. 5, all twelve holes 160 are open and the adapter 10' is subjected to full power, with maximum flow passing over or through the vacuum cleaner motor.

By rotating the rotatable shield from the position shown in FIG. 5 to the position shown in FIG. 6, all twelve holes are completely covered such that the air flow to the cooling motor is reduced ½ by uncovering six similar holes 160, in a set circumferentially shifted by near 180° and the system is under half power.

Advantageously a stop or bar 186 is fixedly mounted within recess 184, having opposite ends of the bar 186*a*, 186*b* abutting and adhesively fixed or otherwise mounted, respectively to end walls of rib 180 and the radially enlarged end 182 of the adapter body 129. By locating at given circumferential position, the fixed stop or bar 186, the rotation of the shield 138 may be limited so that the shield 138 is rotatable only between two extreme positions, one in which all twelve of the one set of holes 160 are uncovered and the second, where only six of the holes 160 of a second set are open to the atmosphere, with the balance of the twelve holes 160 effectively covered and blocked by the imperforate cylindrical shield 138 as per FIG. 6.

While the description above is to preferred embodiments and contains specific parameters and location and connection details these should not be construed as limitations of the scope of the invention and the system and the adapter as illustrated in the drawings are exemplary only. The scope of the invention is determined not by illustrated embodiments, but by the dependent claims and their legal equivalents.

I claim:

1. A vacuum cleaner adaptor for a micro tool for a vacuum cleaner employing an air cooled or air pass through motor for preventing overheating of the vacuum cleaner motor during operation, said vacuum cleaner including suction and positive air pressure sides passing air flow over or through said vacuum cleaner motor, said adaptor comprising a tubular assembly including an adaptor body having a large diameter tube section for attachment to the suction or positive air pressure side of the vacuum cleaner, a small diameter tube section sized to the micro tool for coupling thereto, and an integral transition section connecting the large diameter section to the small diameter section, one of said adaptor body sections comprising a plurality of air flow ports opening to the interior of the adaptor, and a shield rotatably mounted on said section carrying said plurality of air flow ports for rotation between a first position in which the ports are open to air flow between the interior and exterior of said adaptor body section, and a second position in which said ports are partially closed off to said air flow and said adaptor further includes stop means for limiting movement of said shield to rotation between said first and second positions thereby insuring prolonged air flow through said tubular assembly for passage through or over said motor adequate to prevent overheating of the vacuum cleaner motor with the rate of air flow through the vacuum cleaner being readily adjustable depending upon the nature of the micro tool attached thereto.

2. The adaptor as claimed in claim 1, wherein, said transition section between said large diameter and said small diameter sections of said adaptor body is of conical form, wherein said air ports comprise circumferentially spaced slots within said conical form section, and said movable shield comprises a conical member concentrically mounted on said adaptor body in flush contact with said conical section of said body, and having circumferentially spaced slots in generally longitudinal alignment with the slots within said adaptor body conical section and means for mounting said conical shield for limited rotation relative to said adaptor body to shift said shield from said first position where said slots are in axial alignment and said second position where said slots are offset to reduce the air flow through said slots for varying the air flow through said adaptor during vacuum cleaner operation of said micro tool.

3. The adaptor as claimed in claim 2, wherein said shield is concentrically mounted about the exterior of said adaptor body, and said adaptor further comprises a stop ring, concentrically mounted about the small diameter section of said adaptor body, having an end face in radial abutment with said conical shield and maintaining the conical shield in surface contact with the exterior of the conical section of said adaptor body.

4. The adaptor as claimed in claim 3, wherein said adaptor body small diameter section includes at least one radially projecting rib on the outer surface thereof, and wherein said stop ring includes an angular groove on the inner periphery thereof sized to and receiving said radial projection for locking said stop ring axially on said adaptor body small diameter section.

5. The adaptor as claimed in claim 2, wherein said movable shield comprises a tubular member, mounted concentrically about said adaptor body, and including in order and integrally a large diameter portion having an inner diameter slightly larger than the outer diameter of said large diameter section of said adaptor body, a conical body transition portion and an integral, small diameter portion having an inner diameter slightly larger than the outer diameter of the small diameter section of said adaptor body, wherein said adaptor body small diameter section includes a plurality radially projecting abutments projecting radially outward from the outer surface thereof towards the radially inner surface of said shield small diameter portion, and wherein said shield small diameter portion includes a like number of radially inwardly directed projections on the inner diameter thereof facing the outer periphery of said adaptor body small diameter section and spaced radially therefrom, and wherein, said radial projections of said shield member and said radial abutments of said adaptor body are angularly offset, so positioned and of such arcuate widths such that arcuate gaps are created therebetween permitting rotation of said shield member over an angular extent of said gaps between positions where the slots of said shield and said adaptor body are in full alignment for maximum air flow therethrough and wherein, said slots are circumferentially offset for reduced air flow.

6. The adaptor as claimed in claim 5, wherein said circumferentially spaced slots within said conical transition section of said adaptor body taper inwardly in a direction from the interior of said adaptor body to the exterior thereof and wherein, the arcuate slots within said shield member conical portion taper outwardly from the inner surface thereof to the outer surface thereof.

7. The adaptor as claimed in claim 2, wherein said large diameter portion of the shield member is knurled on the outer periphery thereof for facilitating manual rotation of said shield about the longitudinal axis of the adaptor.

8. A vacuum cleaner adaptor for a micro tool for a vacuum cleaner employing an air cooled or air pass through motor for preventing overheating of the vacuum cleaner motor during operation, said adaptor comprising a tubular assembly including an adaptor body having a large diameter tube section for attachment to the suction or positive air pressure side of the vacuum cleaner, a small diameter tube section sized to the micro tool for coupling thereto, and an integral transition section connecting the large diameter section to the small diameter section, one of said adaptor body sections comprising a plurality of air flow ports opening to the interior of the adaptor, and a shield movably mounted on said section carrying said plurality of air flow ports for movement between a first position in which the ports are open to air flow between the interior and exterior of said adaptor body section, and a second position in which said ports are partially closed off to said air flow and thereby insuring prolonged air flow adequate to prevent overheating of the vacuum cleaner motor with the rate of air flow through the vacuum cleaner being readily adjustable depending upon the nature of the micro tool attached thereto and stop means for limiting said shield to movement between said first and second positions, and wherein said large diameter section of said adaptor body includes a radially projecting rib intermediate the ends thereof, and a radially projecting end wall proximate to said transition section, axially spaced from said rib and defining a circumferential recess therebetween, said shield comprises a semicircular cylindrical section of solid sector shape having an inner diameter slightly in excess of the outer diameter of said adaptor body recess, and being concentrically mounted thereto with opposite ends in abutment with said radial rib and said radially enlarged end wall, and wherein, said multiple air flow ports comprise a plurality of holes within said adaptor body large diameter section at said recess, oblique to the axis of said adaptor body and in at least one circumferential array whereby, rotation of said sector shape shield selectively closes off said oblique holes to vary the rate of air flow through said adaptor.

9. The adaptor as claimed in claim 8, wherein aid oblique air flow holes, are longitudinally and circumferentially spaced to form a series of longitudinal rows of said holes which rows are selectively closed off by rotation of said shield of sector shape.

10. The adaptor as claimed in claim 9, wherein said stop means comprise at least one stop bar fixedly mounted within the recess of said adaptor body large diameter section and having opposite ends abutting at said rib and said large diameter end wall for limiting rotation of said sector form shield to limit closure of said holes extending obliquely through said large diameter section for ensuring adequate flow of cooling air to said vacuum cleaner motor during operation of said micro tool.

* * * * *